US008510922B2

(12) United States Patent
Turi et al.

(10) Patent No.: US 8,510,922 B2
(45) **Date of Patent: *Aug. 20, 2013**

(54) HYDROENGORGED SPUNMELT NONWOVENS

(75) Inventors: Mordechai Turi, Princeton Junction, NJ (US); Michael Kauschke, Prien (DE)

(73) Assignee: First Quality Nonwovens, Inc., State College, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/323,434

(22) Filed: Dec. 12, 2011

(65) Prior Publication Data

US 2012/0091614 A1 Apr. 19, 2012

Related U.S. Application Data

(63) Continuation of application No. 11/888,757, filed on Aug. 2, 2007, now Pat. No. 8,093,163, which is a continuation of application No. 10/938,079, filed on Sep. 10, 2004, now Pat. No. 7,858,544.

(51) Int. Cl.
*D04H 1/46* (2012.01)

(52) U.S. Cl.
USPC ..... 28/104; 442/384; 442/408

(58) Field of Classification Search
USPC ..... 28/104; 442/384, 408
See application file for complete search history.

(56) References Cited

U.S. PATENT DOCUMENTS

| | | | |
|---|---|---|---|
| 3,485,706 | A | 12/1969 | Evans |
| 4,039,711 | A | 8/1977 | Newman |
| 4,808,467 | A | 2/1989 | Suskind et al. |
| 4,810,556 | A | 3/1989 | Kobayashi et al. |
| 4,921,643 | A | 5/1990 | Walton et al. |
| 4,950,531 | A | 8/1990 | Radwanski et al. |
| 5,019,065 | A | 5/1991 | Scripps |
| 5,098,764 | A | 3/1992 | Drelich et al. |
| 5,136,761 | A | 8/1992 | Sternlieb et al. |
| 5,151,320 | A | 9/1992 | Homonoff et al. |
| 5,204,165 | A | 4/1993 | Schortmann |
| 5,284,703 | A | 2/1994 | Everhart et al. |
| 5,292,581 | A | 3/1994 | Viazmensky et al. |
| 5,383,872 | A | 1/1995 | Roessler et al. |
| 5,389,202 | A | 2/1995 | Everhart et al. |
| 5,391,415 | A | 2/1995 | Bair |
| 5,527,305 | A | 6/1996 | Goulait et al. |
| 5,533,991 | A | 7/1996 | Kirby et al. |
| 5,614,281 | A | 3/1997 | Jackson et al. |
| 5,624,429 | A | 4/1997 | Long et al. |

(Continued)

FOREIGN PATENT DOCUMENTS

| | | |
|---|---|---|
| EP | 834938 | 4/1998 |
| EP | 1 172 188 B1 | 1/2002 |

(Continued)

OTHER PUBLICATIONS

Insight Conference 2003, Presentation Highlights by Rieter Perfojet.

*Primary Examiner* — Elizabeth Cole

(74) *Attorney, Agent, or Firm* — Amster, Rothstein & Ebenstein LLP

(57) ABSTRACT

A hydroengorged spunmelt nonwoven formed of thermoplastic continuous fibers and a pattern of fusion bonds. The nonwoven has either a percentage bond area of less than 10 percent, or a percentage bond area of at least 10% wherein the pattern of fusion bonds is anisotropic.

18 Claims, 20 Drawing Sheets

(56) References Cited

U.S. PATENT DOCUMENTS

| | | | |
|---|---|---|---|
| 5,645,915 | A | 7/1997 | Oathout |
| 5,645,916 | A | 7/1997 | Oathout |
| 5,843,057 | A | 12/1998 | McCormack |
| 5,935,880 | A | 8/1999 | Wang et al. |
| 5,961,505 | A | 10/1999 | Coe et al. |
| 6,110,848 | A | 8/2000 | Bouchette |
| 6,162,961 | A | 12/2000 | Tanner et al. |
| 6,177,370 | B1 | 1/2001 | Skoog et al. |
| 6,192,556 | B1 | 2/2001 | Kikko et al. |
| 6,200,669 | B1 | 3/2001 | Marmon et al. |
| 6,277,104 | B1 | 8/2001 | Lasko et al. |
| 6,321,425 | B1 | 11/2001 | Putnam et al. |
| 6,348,253 | B1 | 2/2002 | Daley et al. |
| 6,419,865 | B1 | 7/2002 | Gryskiewicz et al. |
| 6,430,788 | B1 | 8/2002 | Putnam et al. |
| 6,491,777 | B1 | 12/2002 | Bevins, III et al. |
| 6,537,644 | B1 | 3/2003 | Kauschke et al. |
| 6,610,383 | B1 | 8/2003 | Morman et al. |
| 6,610,390 | B1 | 8/2003 | Kauschke et al. |
| 6,613,028 | B1 | 9/2003 | Daley et al. |
| 6,632,385 | B2 | 10/2003 | Kauschke et al. |
| 6,632,504 | B1 | 10/2003 | Gillespie et al. |
| 6,642,160 | B1 | 11/2003 | Takahashi |
| 6,735,833 | B2 | 5/2004 | Putnam et al. |
| 6,770,065 | B1 | 8/2004 | Sasaki et al. |
| 6,794,557 | B1 | 9/2004 | Klemp et al. |
| 6,803,103 | B2 | 10/2004 | Kauschke et al. |
| 6,817,994 | B2 | 11/2004 | Popp et al. |
| 6,851,164 | B2 | 2/2005 | Andersen |
| 6,903,034 | B1 | 6/2005 | Putnam et al. |
| 7,091,140 | B1 | 8/2006 | Ferencz et al. |
| 2002/0077618 | A1 | 6/2002 | Molas |
| 2002/0104203 | A1 | 8/2002 | Greenway et al. |
| 2002/0144384 | A1 | 10/2002 | Maugans |
| 2003/0106560 | A1 | 6/2003 | Griesbach, III et al. |
| 2003/0118776 | A1 | 6/2003 | Anderson et al. |
| 2003/0119403 | A1 | 6/2003 | Willis et al. |
| 2003/0125695 | A1 | 7/2003 | Dorschner |
| 2003/0135191 | A1 | 7/2003 | Price et al. |
| 2003/0135192 | A1 | 7/2003 | Guralski et al. |
| 2003/0191442 | A1 | 10/2003 | Bewick-Sonntag et al. |
| 2003/0203698 | A1 | 10/2003 | Gillespie et al. |
| 2004/0010894 | A1 | 1/2004 | Goldwasser et al. |
| 2004/0198124 | A1 | 10/2004 | Polanco et al. |
| 2004/0201125 | A1 | 10/2004 | Allen et al. |
| 2004/0203309 | A1 | 10/2004 | Allen et al. |
| 2005/0079321 | A1 | 4/2005 | Tuman et al. |
| 2005/0215156 | A1 | 9/2005 | Ferencz et al. |
| 2006/0058772 | A1 | 3/2006 | Karami |

FOREIGN PATENT DOCUMENTS

| | | | |
|---|---|---|---|
| EP | 1 382 731 | A1 | 1/2004 |
| EP | 1 047 364 | B1 | 7/2004 |
| JP | 01-132862 | | 5/1989 |
| JP | 11-019015 | | 1/1999 |
| WO | 00/29658 | | 5/2000 |
| WO | WO 01/53588 | A3 | 7/2001 |
| WO | WO 02/084006 | A1 | 10/2002 |

HYDROENGORGED SPUNMELT NONWOVENS

CROSS REFERENCE TO RELATED APPLICATIONS

This is a continuation of U.S. patent application Ser. No. 11/888,757, filed Aug. 2, 2007, which in turn is a continuation of U.S. patent application Ser. No. 10/938,079, filed Sep. 10, 2004, now U.S. Pat. No. 7,858,544, the contents of which are incorporated herein by reference in their entirety.

BACKGROUND OF THE INVENTION

The present invention relates to spunmelt nonwovens, and more particularly such spunmelt nonwovens which are hydroengorged.

Spunmelt nonwovens (e.g., spunbond or meltblown nonwovens) are formed of thermoplastic continuous fibers such as polypropylene (PP), polyethylene terephthalate (PET) etc., bi-component or multi-component fibers, as well as mixtures of such spunmelt fibers with rayon, cotton and cellulosic pulp fibers, etc. Conventionally, the spunmelt nonwovens are thermally, ultrasonically, chemically (e.g., by latex), or resin bonded, etc., so as to produce bonds which are substantially non-frangible and retain their identity through post-bonding processing and conversion. Thermal and ultrasonic bonding produce permanent fusion bonds, while chemical bonding may or may not produce permanent bonding. Typically fusion-bonded spunmelt nonwovens have a percentage bond area of 10-35%, preferably 12-26%.

Generally, the prior art teaches that hydroentanglement of a spunmelt nonwoven requires that, in order to increase or maintain tensile strength, the spunmelt nonwoven initially be essentially devoid of fusion bonds and that any bonds initially present be of the frangible type which are to a large degree broken during the hydroentanglement process. See, for example, U.S. Pat. Nos. 6,430,788 and 6,321,425; and U.S. Patent Application Publication Nos. 2004/0010894; and 2002/0168910. Hydroentanglement of such unbonded or frangibly bonded spunmelts is used primarily to add integrity and therefore tensile strength to the spunmelt nonwoven.

In order to facilitate conversion (that is, further processing of a spunmelt nonwoven), it is necessary that the nonwoven have an appropriate tensile strength for the conversion processing. The acceptable "window" for tensile strength will vary with the intended conversion processing.

In the case of the unbonded or frangibly bonded spunmelt nonwovens, the initial integrity or tensile strength is very low, and the use of a hydroentanglement step increases the integrity and tensile strength (relative to what it was before) such that the spunmelt nonwoven can undergo the conversion process. However, the prior art generally teaches that, because of the nature of the fusion bonded spunmelt nonwoven prior to hydroentanglement, such spunmelt nonwovens subsequent to hydroentanglement exhibit only a limited level of integrity and a relatively low tensile strength, one which is frequently substantially diminished, relative to the tensile strength of the fusion bonded spunmelt nonwoven prior to hydroentanglement, due to breakage of the fibers. Thus, hydroentanglement of fusion bonded spunmelt nonwovens may lower the integrity and tensile strength of the spunmelt nonwoven to such an extent that it is no longer suitable for the desired subsequent conversion processing.

Accordingly, it is an object of the present invention to provide, in one preferred embodiment, a hydroengorged spunmelt nonwoven formed of thermoplastic continuous fibers and a pattern of fusion bonds.

Another object is to provide, in one preferred embodiment, such a spunmelt having a percentage fusion bond area of less than 10%.

A further object is to provide, in one preferred embodiment, such a spunmelt nonwoven having a percentage fusion bond area of at least 10% wherein the pattern of fusion bonds is anisotropic.

It is also an object of the present invention to provide, in one preferred embodiment, such a spunmelt nonwoven which exhibits after hydroengorgement an increase in caliper of at least 50% and a tensile strength of at least 75% of the tensile strength exhibited by the spunmelt nonwoven prior to hydroengorgement.

SUMMARY OF THE INVENTION

It has now been found that the above and related objects of the present invention are obtained in a hydroengorged spunmelt nonwoven formed of thermoplastic continuous fibers and providing a pattern of fusion bonds. The nonwoven has one of (i) a positive percentage fusion bond area of less than 10%, and (ii) a percentage fusion bond area of at least 10% wherein the pattern of fusion bonds is anisotropic.

In a preferred embodiment, the nonwoven is orthogonally differentially bonded with fusion bonds. The bonds have a maximum dimension d, and a maximum bond separation of at least 4d. The nonwoven after hydroengorgement exhibits an increase in caliper of at least 50% (i.e., loft or thickness) relative to the nonwoven prior to hydroengorgement. Further, the nonwoven after hydroengorgement exhibits a tensile strength of at least 75% relative to the nonwoven prior to hydroengorgement.

A preferred basis weight is 5-50 gsm.

The present invention further encompasses an absorbent article including such a nonwoven, a non-absorbent article including such nonwoven, or a laminate or blend (mixture) including such a nonwoven. The nonwoven may further include a finish for modifying the surface energy thereof or increasing the condrapable nature thereof.

The present invention also encompasses a hydroengorged synthetic fiber structure having a pattern of fusion bonds. The structure has one of (i) a positive percentage fusion bond area of less than 10%, and (ii) a percentage fusion bond area of at least 10% where the pattern bonds is anisotropic. Preferably the structure is formed of a spunmelt nonwoven having thermoplastic continuous fibers.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
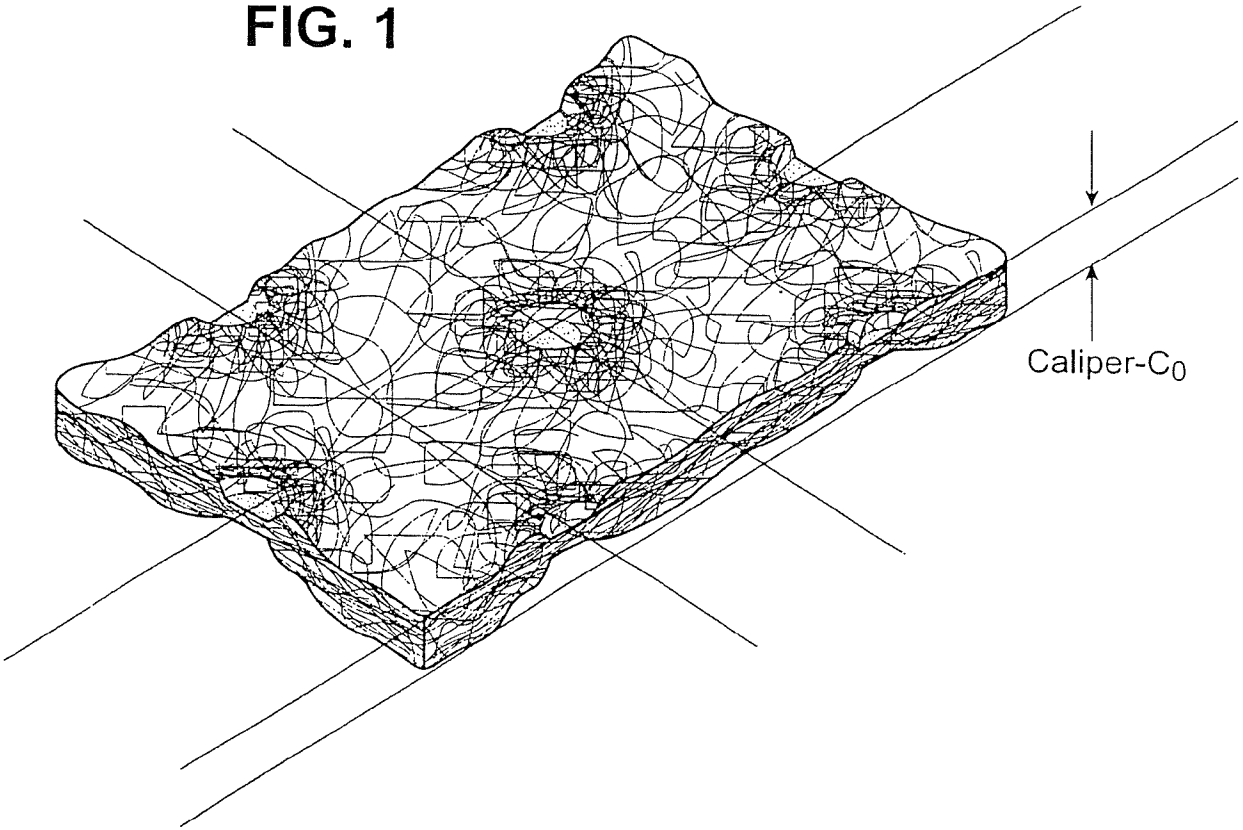
FIGS. 1 and 2 are schematic isometric views, partially in section, of a spunmelt nonwoven with a less than 10% bond area, before and after hydroengorgement, respectively.

The term "hydroengorgement" as used herein and in the claims refers to a process by which hydraulic energy is applied to a nonwoven fabric such that there is a resultant increase in caliper as well as in softness, both relative to the nonwoven fabric prior to hydroengorgement. Preferably there is an increase of at least 50% in caliper. At the same time, where the nowoven fabric has a pattern of fusion bonds therein, there is generally a decrease in tensile strength due to the hydroengorgement, although the decrease in tensile strength is typically less than that produced by conventional hydroentanglement. Preferably the tensile strength after hydroengorgement is at least 75% of the tensile strength prior to hydroengorgement.

While the hydroengorgement process will, like such other hydraulic processes as hydroentanglement, water needling, and the like, inevitably produce some breakage of the fibers of a nonwoven fabric having a pattern of fusion bonds therein, in the hydroengorgement process such fiber breakage is not a goal of the process since hydroengorgement does not have as a desired function thereof the rotation, encirclement and entwinement of broken fiber ends to produce fiber entanglement. To the contrary, hydroengorgement is concerned with the production of increased caliper and softness (the two in combination typically being referred to herein as "increased bulk").

While the apparatus used to produce hydroengorgement is, broadly speaking, similar to that conventionally used in hydroentanglement and water needling processes, there are differences in how such apparatus is used as well as the nature of the nowoven upon which it is used. As noted hereinbelow, the spunmelt nonwoven useful in the present invention has either a positive percentage fusion bond area of less than 10% or a percentage fusion bond area of at least 10% wherein the bonding pattern of the fusion bonds is anisotropic.

First, typically the hydroengorgement process will provide on each side of the nonwoven a single row or beam of hydraulic jets generally transverse to (i.e., either normal to or at less than a 45° angle to) the machine direction of the movement of the nowoven. There may be two of the rows on each side of the nonwoven, but a greater number of rows is generally not necessary.

Second, the quantity of hydraulic energy imparted to the nowoven by the hydraulic jets is designed to minimize and limit the amount of fiber breakage on any given forming surface, while still being sufficient to achieve the fiber movement required to produce increased caliper and increased softness in the nonwoven. The hydroengorgement process does not require breakage of the fibers because there is already a sufficiently long free fiber length due to the positive percentage fusion bond area being less than 10% or the anisotropic nature of the bonding pattern of the fusion bonds where the percentage fusion bond area is at least 10%.

As discussed below, other operating parameters which may differ in the hydroengorgement process from those of other hydraulic energy-imparting processes of the prior art include the size and design of the water jets orifices or nozzles, the spacing apart of the water jet orifices on any given row, the design of the forming surface underneath the nonwoven, the travel speed of the nonwoven, and the like. The desirable balances of these and other parameters of the hydroengorgement process so as to achieve the hereinabove-identified goals of the present invention, relative to a given spunmelt nonwoven having a particular quantity and pattern of fusion bonds, are within the scope of this invention.

A nonwoven of the present invention is formed of thermoplastic continuous fibers and has a pattern of fusion bonds. In a fusion bond, the continuous fibers passing through the bond are fused together at the bond so as to form a non-frangible or permanent bond. Movement of the fibers intermediate the bonds is limited by the free fiber length (that is, the length of the fiber between two adjacent bonds thereon) unless the fiber itself becomes broken so that it no longer extends between the adjacent bonds (as commonly occurs in hydroentanglement processes).

Figure 7:
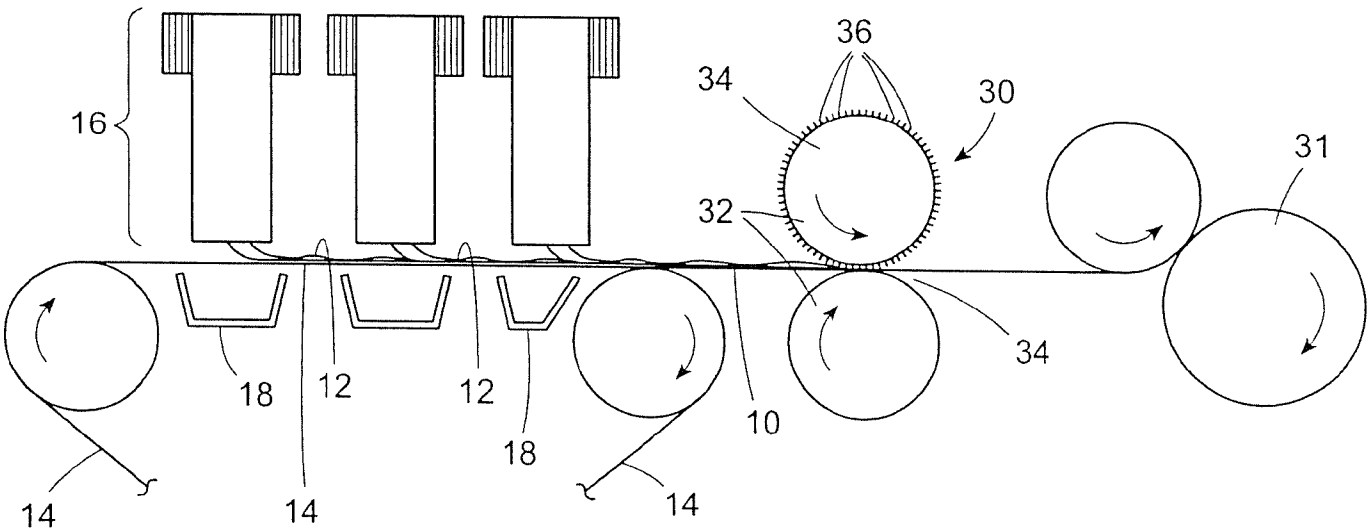
FIG. 7 is a schematic of the apparatus and process used for meltspinning and fusion bonding of a fusion bonded spunmelt nonwoven.

Referring now to the drawing, and in particular to FIG. 7 thereof, spunmelt nonwoven fabrics 10 are made of continuous strands or filaments 12 that are laid down on a moving conveyor belt 14 in a randomized distribution. In a typical spunmelt process, resin pellets are processed under heat into a melt and then fed through a spinnerette to create hundreds of thin filaments or threads 12 by use of a drawing device 16. Jets of a fluid (such as air) cause the threads 12 to be elongated, and the threads 12 are then blown or carried onto a moving web 14 where they are laid down and sucked against the web 14 by suction boxes 18 in a random pattern to create a fabric 10. The fabric 10 then passes through a bonding station 30 prior to being wound on a winding/unwinding roll 31. Bonding is necessary because the filaments or threads 12 are not woven together.

The typical fusion bonding station 30 includes a calender 32 having a bonding roll 34 defining a series of identical raised points or protrusions 36. Typically, these bonding points 36 are generally equidistant from each other and are in a uniform and symmetrical pattern extending in all directions (that is, an isotropic pattern), and therefore in both the machine direction (MD) and the cross direction (CD). Alternatively, the typical fusion bonding station 30 may have an ultrasonic device or a through-air device using air at elevated temperatures sufficient to cause fusion bonding.

Figure 8A:
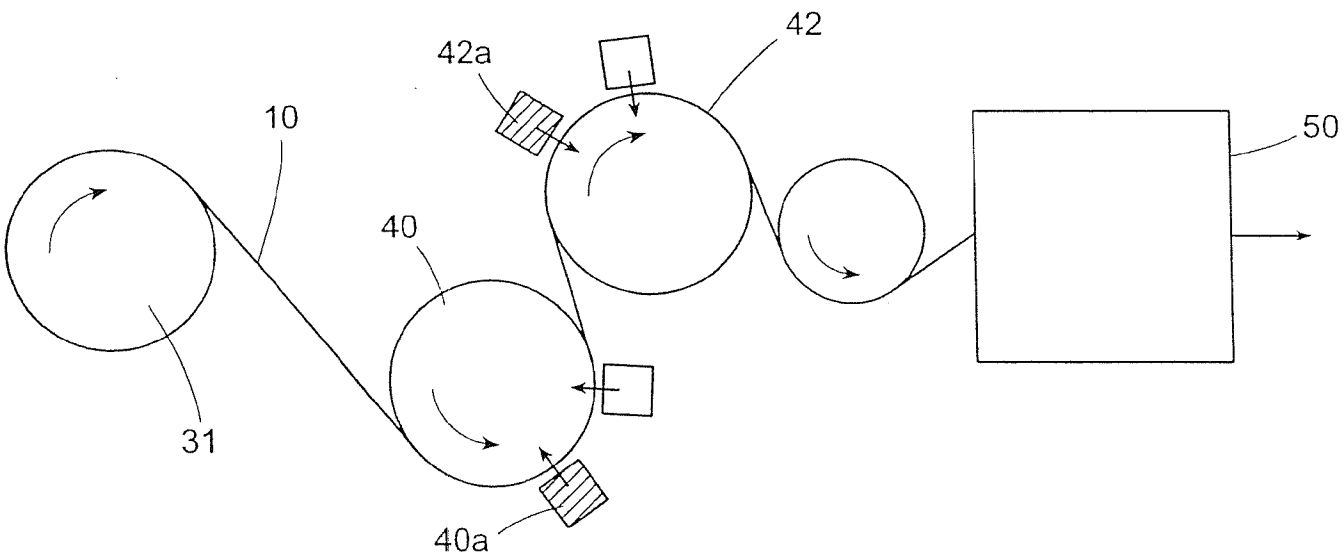
FIGS. 8A and 8B are schematic representations of the apparatus process used in hydroengorging and then drying the fusion bonded spunmelt fabric, using a drum design or a belt design, respectively.

Referring now to FIG. 8A, therein illustrated is an apparatus for hydroengorgement using a drum design. The apparatus includes the winding/unwinding roll 31 from which the fusion bonded fabric 10 is unwound. The fabric 10 then passes successively through two hydroengorgement stations 40, 42. Each hydroengorgement station 40, 42 includes at least one water jet beam 40*a*, 42*a*, respectively, and optionally a second water jet beam adjacent thereto. The fabric 10 is wound about the hydroengorgement stations 40, 42 such that each beam 40*a*, 42*a* directs its water jets onto an opposite side of the fabric 10. Finally, the now hydroengorged fabric 10 is passes through a dryer 50.

Figure 8B:
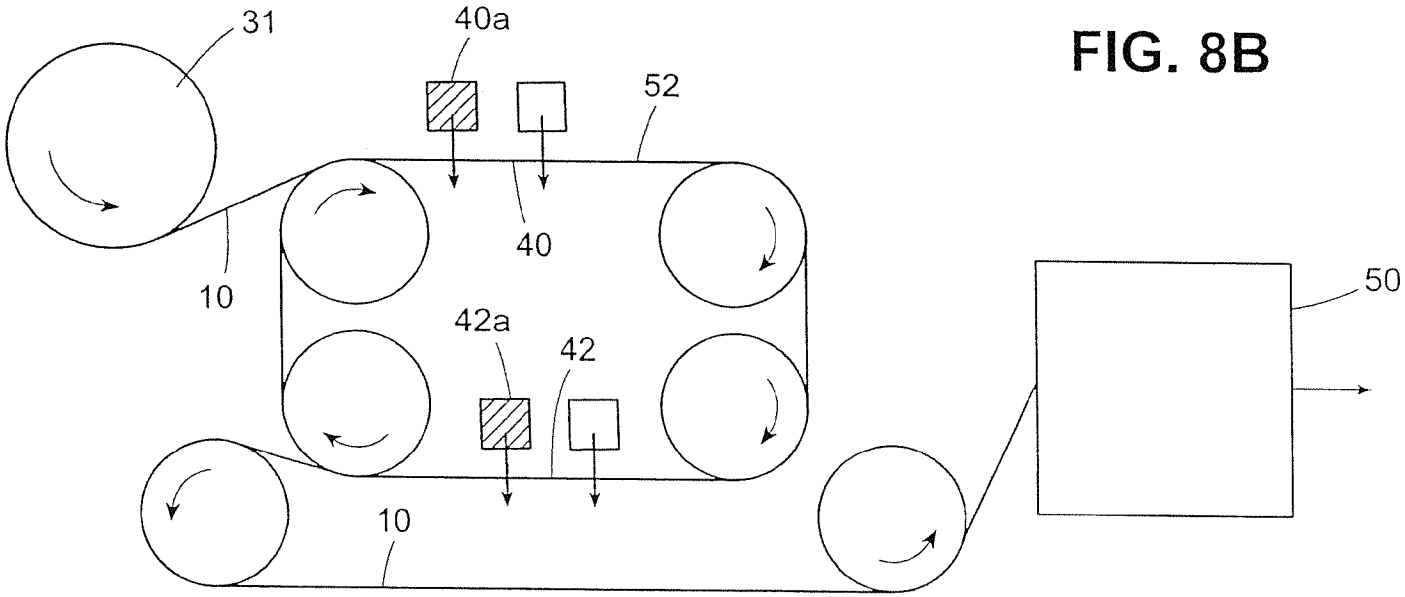

Whereas FIG. 8A illustrates the apparatus used for hydroengorgement using a drum design, FIG. 8B illustrates the apparatus used for hydroengorgement using a belt design. The fabric 10 in this instances moves from the winding/unwinding roll 31 onto a water-permeable belt or conveyor 52 which transports it through a first hydroengorgement station 40 containing at least one beam 40*a* and a second hydroengorgement station 42 containing at least one water jet beam 42*a*. The beams 40*a*, 42*a* direct the water jets onto opposite surfaces of the fabric 10. Finally, the now hydroengorged fabric 10 is passed through dryer 50.

In a preferred embodiment of the present invention, the row or beam which contains the water orifices is disposed one or two on each side of the nonwoven surface, preferably only one on each side. The beams preferably have a linear density of 35 to 40 orifices per inch, 40 being especially preferred. The diameter of the water orifices is preferably 0.12-0.14 millimeters, 0.12 millimeters being especially preferred. The applied pressure is preferably 180-280 bar, 240 bar being especially preferred. The travel speed of the nonwoven through the hydroengorgement station is preferably generally about 400 meters per minute, although slower or faster speeds may be dictated by other operations being performed on the nonwoven. The forming surface, located below the nonwoven and above the water suction slot, is preferably a wire screen surface of 15 to 100 mesh, 25-30 being optimum. Obviously the spunmelting, fusion bonding and hydroengorgement is preferably conducted in an integrated in-line process.

Commonly owned U.S. Pat. Nos. 6,537,644 and 6,610,390, and application Ser. No. 09/971,797, filed Oct. 5, 2001, each of which is incorporated herein by reference, disclose nonwovens having a non-symmetrical pattern of fusion bonds (that is, an anisotropic or asymmetrical pattern). As disclosed in these documents, bonds in an asymmetrical pattern may have a common orientation and common dimensions, yet define a total bond area along one direction (e.g., the MD) greater than along another direction (e.g., the CD) which is oriented orthogonally to the first direction, such that the points form a uniform pattern of bond density in one direction different from the uniform pattern of bond density in the other direction. Alternatively, as also disclosed in these documents, the bonds themselves may have varying orientations or varying dimensions, thereby to form a pattern of bond density which differs along the two directions. The bonds may be simple fusion bonds or closed figures elongated in one direction. The bonds may be closed figures elongated in one direction and selected from the group consisting of closed figures (a) oriented in parallel along the one direction axis, (b) oriented transverse to adjacent closed figures along the one direction axis, and (c) oriented sets with proximate closed figures so as to form therebetween a closed configuration elongated along the one direction axis.

While the aforementioned documents disclose orthogonally differential bonding patterns (that is, bonding patterns which define a total bond area along a first direction axis greater than along a second direction axis orthogonal or normal thereto), the anisotropic bonding pattern useful in the present invention requires only that the total bond area along a first direction axis differs from the total bond area along a second direction axis, without regard to whether the first and second directions axes are orthogonal or normal to one another. While all orthogonally differential bonding patterns are anisotropic, anisotropic bonding patterns need not be orthogonally differential.

The present invention ensures that there are a sufficient number of fibers in the nonwoven with a suitably long free fiber length—that is, that the length of the fiber between adjacent bonds thereon is suitably long. The greater the distance between adjacent bonds along a given fiber, the greater is the maximum possible free fiber length. The greater the free fiber length, the more the fiber is available for hydroengorgement (i.e., for bulking). In conventional symmetrical bonding—i.e., symmetrical patterns that have a multitude of fusion bonds in close proximity to each other—the free length of the fibers is uniformly relatively short where the percentage bond area is at least 10%. As a result, the fibers are constrained by the bonds from expanding in the vertical or "z" direction (i.e., normal to the plane of the nonwoven) for bulking. Accordingly, in conventional bonding there are constraints on the increase in bulking (that is, expansion in the vertical or "z" direction).

By way of contrast, hydroengorgement of nonwoven fabrics with asymmetrical or anisotropic bond patterns according to the present invention yields greater caliper and softness compared to fabrics with symmetrical patterns of the same overall bond area. Furthermore, hydroengorgement of nonwovens with such anisotropic patterns results in lesser decreases in the tensile strength of the nonwovens as a result of the hydroengorgement process (and its inevitable breaking of at least some of the fibers of the nonwoven) relative to the nonwovens with isotropic patterns.

If there is no positive percentage fusion bond area (that is, the percentage fusion bond area is zero), the nonwoven will be characterized by an extremely low tensile strength prior to hydroengorgement. Accordingly, nonwovens with a zero percentage fusion bond area are outside the scope of the present invention.

Figure 2:
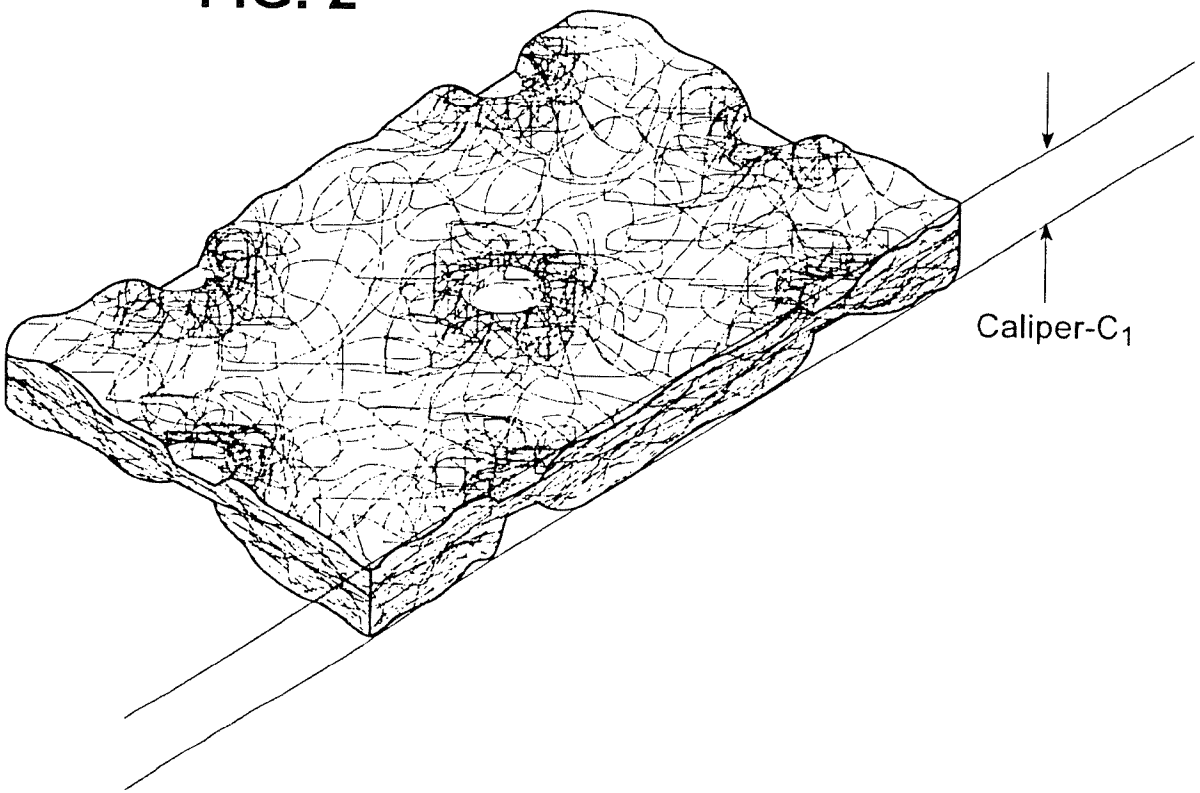
Figure 3:
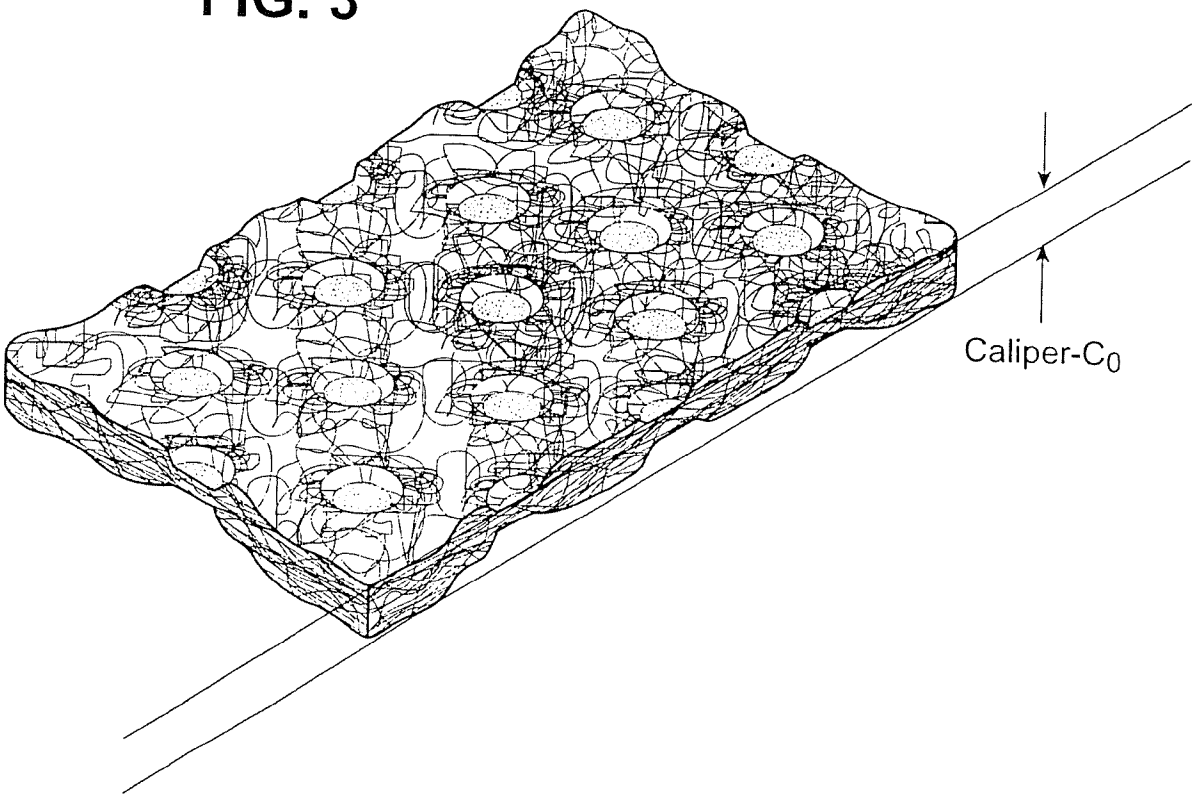
FIGS. 3 and 4 are schematic isometric views, partially in section, of a spunmelt nonwoven with at least a 10% bond area wherein the pattern of fusion bonds is isotropic, before and after hydroengorgement, respectively.

It will be appreciated that the present invention contemplates two techniques for providing spunmelt nonwovens with fibers having a suitable free fiber length. Referring now to FIGS. 1 and 2 in particular, the first technique involves the use of a pattern providing a positive but low percentage fusion bond area. Assuming for example that the bonds are of identical configurations and dimensions, the lower the percentage bond area, the higher the average free fiber length. It has been found that, as long as the positive percentage bond area is less than 10%, the average free fiber length will be suitable for the purposes of the present invention. The closer the percentage bond area approaches 10%, the greater the tensile strength of the nonwoven prior to hydroengorgement and, presumably, subsequent to hydroengorgement. Indeed, a nonwoven having a positive percentage bond area of less than 10% may have either an anisotropic pattern or an isotropic pattern of fusion bonds and still provide a suitable average free fiber length suitable for use in the present invention. FIGS. 1 and 2 illustrate the nonwoven with less than 10% bond area, pre-hydroengorgement and post-hydroengorgement, respectively. For a nonwoven having a positive percentage fusion bond area less than 10%, the original caliper $C_o$ of FIG. 1 is increased by hydroengorgement to the caliper $C_1$ of FIG. 2.

Figure 4:
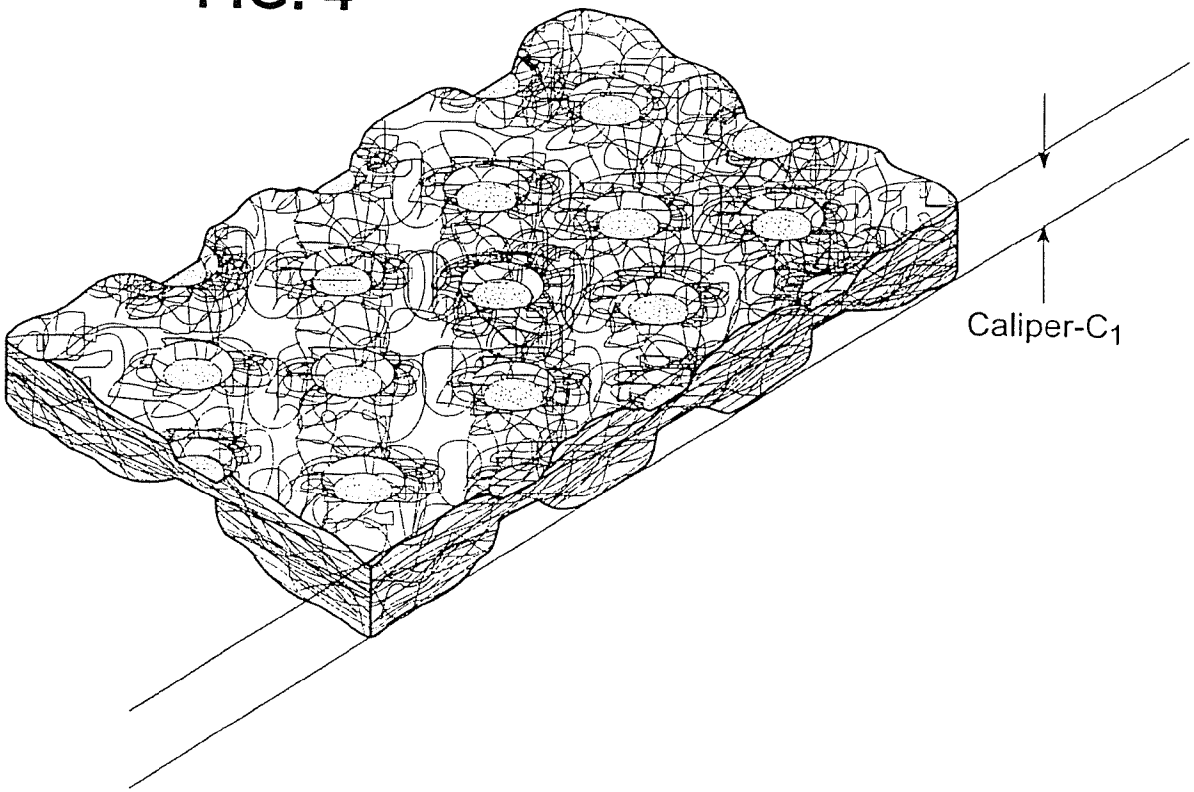
Figure 5:
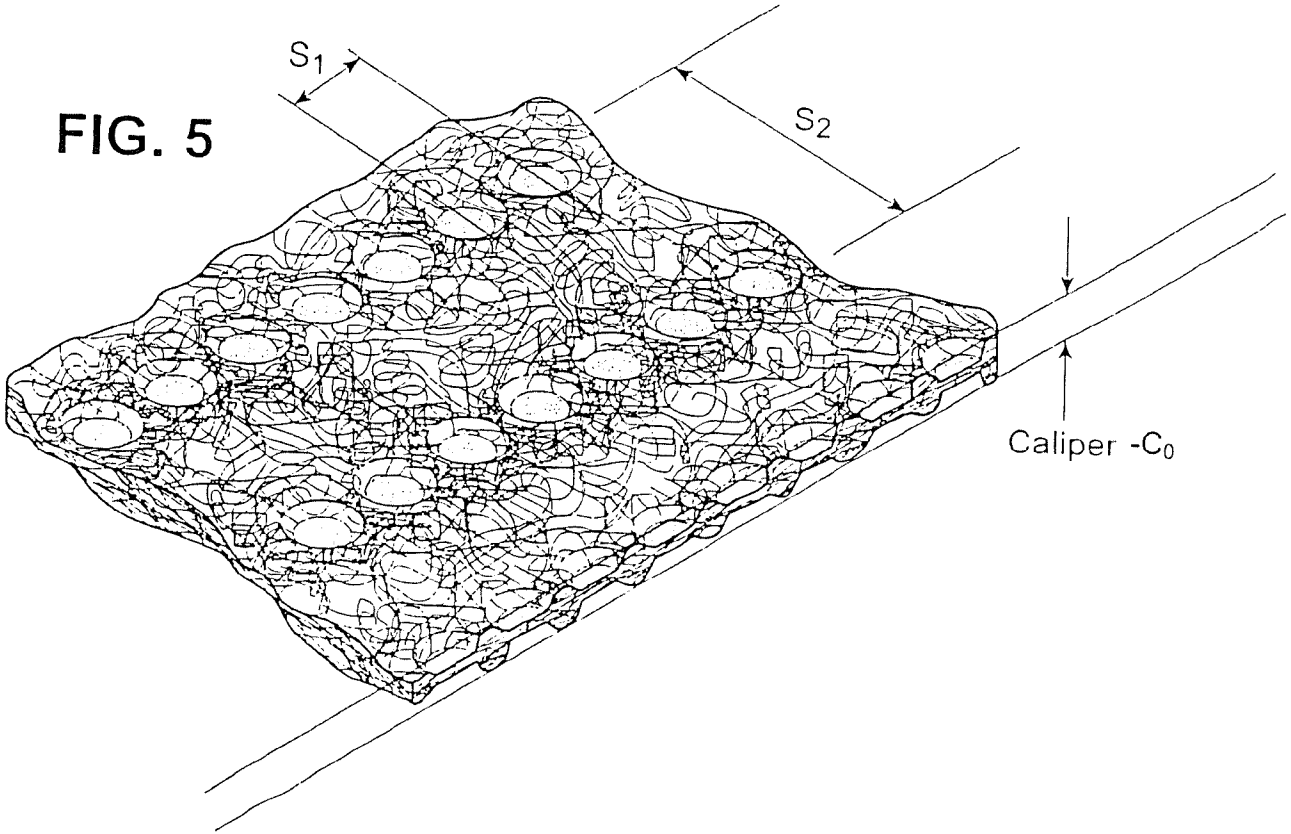
FIGS. 5 and 6 are schematic isometric views, partially in section, of a spunmelt nonwoven with the same bond area as FIGS. 3 and 4, but wherein the pattern of fusion bonds is anisotropic, before and after hydroengorgement, respectively.
Figure 6:
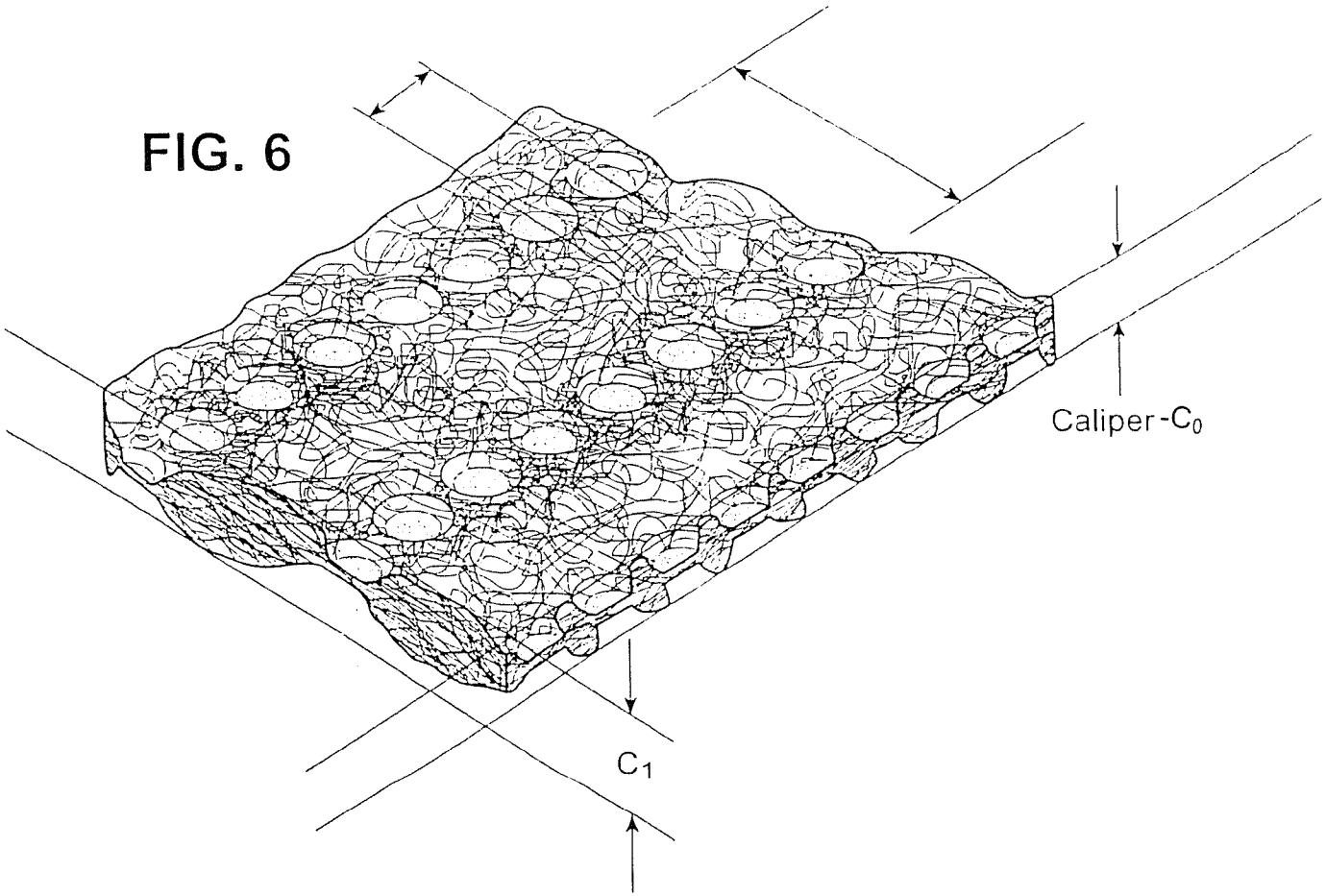

On the other hand, referring now to FIGS. 3-6 in particular, when the percentage fusion bond area is at least 10%, the average free fiber length is so reduced that the advantages of the present invention are obtained only when the fusion bond pattern is anisotropic. Thus, $C_o$ of FIG. 3 and $C_1$ of FIG. 4 are substantially the same for an isotropically (symmetrically) bonded nonwoven. By way of contrast $C_o$ of FIG. 5 is increased to $C_1$ of FIG. 6 for an anisotropically (asymmetrically) bonded nonwoven.

The higher the percentage bond area (above 10%), the more important it is that the bonding pattern be anisotropic to insure that there are an adequate number of fibers exhibiting a suitable free fiber length to promote bulking. While there will probably be a large number of fibers exhibiting less than a suitable free fiber length for the promotion of bulking (i.e., increased caliper and softness), the use of an anisotropic bonding pattern ensures that there will remain an adequate number of fibers exhibiting a suitable free fiber length useful in the present invention. Indeed, for a given percentage bond area in an anisotropic pattern, the lower the free fiber length exhibited by some of the fibers, the greater will be the free fiber length exhibited by other fibers.

Assuming that the bonds have a maximum dimension d (e.g., a diameter of d where the bonds are circular in plan), it has been found that a preferred maximum bond separation (that is, one providing a suitable free fiber length) is at least 4d, preferably at least 5d.

The maximum bond dimension d is measured as the maximum dimension of the imprint left by the forming protrusion on the nonwoven. As a practical matter, it is generally impossible to trace the path of a fiber between a pair of adjacent bonds in order to determine the free fiber length between such bonds. However, clearly the length of the fiber between the two bonds cannot be less than the separation between the bonds. Thus, as a practical matter, one determines the bond separation (that is, the distance between a pair of adjacent bonds) and, assuming that the fiber might extend in a straight line between the adjacent bonds, assumes that the free fiber length of a fiber between the pair of adjacent bonds is at the very least the bond separation. The bond separation is measured using an optical or electronic microscope with a measuring reference and taken herein to be the absolute distance between a pair of adjacent bonds. Where the bond in question is actually a cluster of bonds, the bond separation is taken as the absolute distance between a pair of adjacent clusters.

Assuming the same overall percentage bond area of at least 10% in both patterns, nonwovens with isotropic bond patterns typically have only unsuitably short bond separations of generally less than about 2d between pairs of adjacent bonds while, by way of contrast, nonwovens with anisotropic patterns typically have a substantial number of suitably large maximum bond separations of at least 4d, preferably at least 5d, between a substantial number of pairs of adjacent bonds as well as typically shorter bond separations of generally less than about 2d between the remaining pairs of adjacent bonds. Accordingly, the anisotropically patterned nonwovens are softer and have greater caliper after hydroengorgement than the isotropically patterned nonwovens after hydroengorgement.

The percentage bond area of the nonwoven is calculated as the total area of the nonwoven occupied by the several bonds in a unit area of the nonwoven divided by the total area of the nonwoven unit area. Where the bonds are of a common area, the total area occupied by the several bonds in a nonwoven unit area may be calculated as the common area of the bonds multiplied by the number of bonds in the nonwoven unit area.

Figure 9:
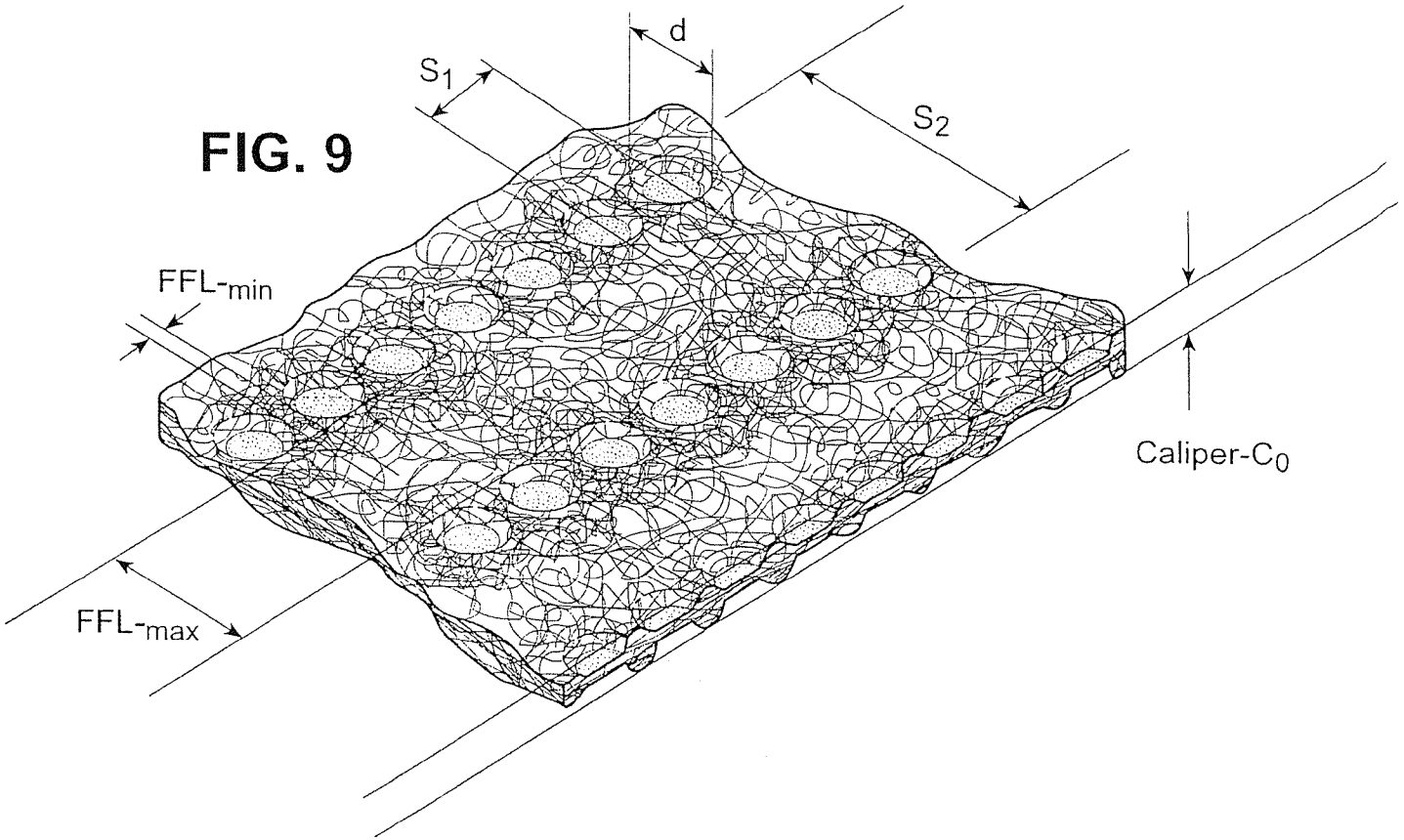
FIG. 9 is a fragmentary isometric schematic of a spunmelt nonwoven having an isotropic pattern of fusion bonds, pre-hydroengorgement.
Figure 10:
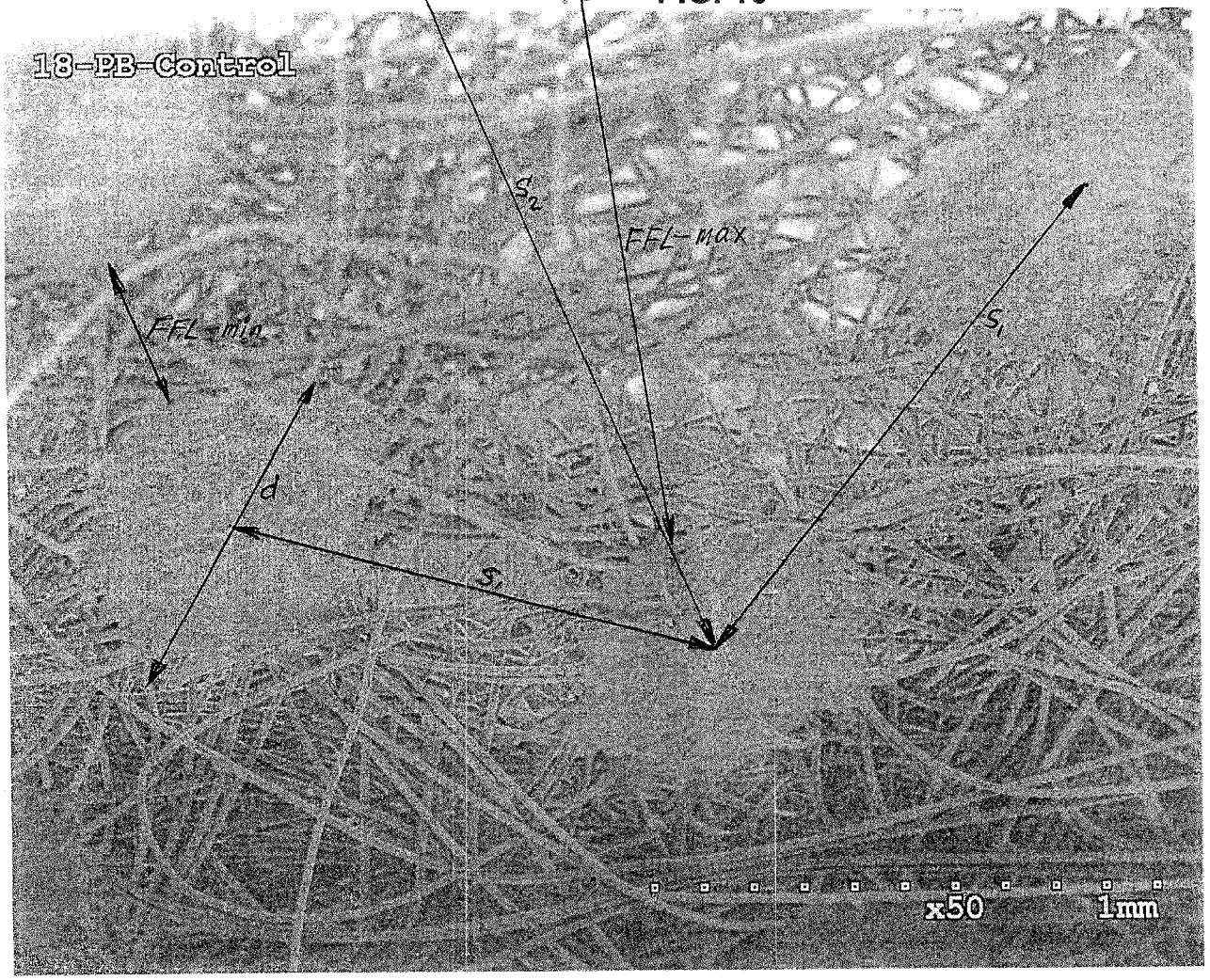
FIG. 10 is an SEM photograph at 50× magnification of a spunmelt nonwoven having an isotropic pattern of fusion bonds, pre-hydroengorgement.

Referring now in particular to FIGS. 9 and 10, FIG. 9 is a fragmentary schematic isometric representation, partially in cross-section, of a spunbond nonwoven having an anisotropic pattern of fusion bonds, and FIG. 10 is an electron scanning microphotograph of the same material taken at a magnification of 50×. In both cases, d represents the length of the long axis of the oval or ellipsoid bonds, $S_1$ represents the shortest center-to-center distance between a pair of adjacent bonds, and $S_2$ represents the longest center-to-center distance. In this particular case $S_1$ and $S_2$ are normal to each other, but this is not necessarily the case. As discussed hereinabove, FFL-min represents the minimum bond separation between a pair of adjacent bonds, and FFL-max represents the maximum bond separation between a pair of adjacent bonds. While the bond distances $S_1$ and $S_2$ are measured from the midpoints of the bonds, the bond separations FFL-min and FFL-max are measured from the adjacent edges of the bonds (that is, the edges of the imprints left by the protrusions of the calender pattern). Again, in this particular case, the FFL-min and FFL-max are normal to each other, but this is not necessarily the case. The caliper of the fabric prior to hydroengorgement is indicated by $C_0$, while the caliper after hydroengorgement will be indicated by $C_1$.

Figure 11:
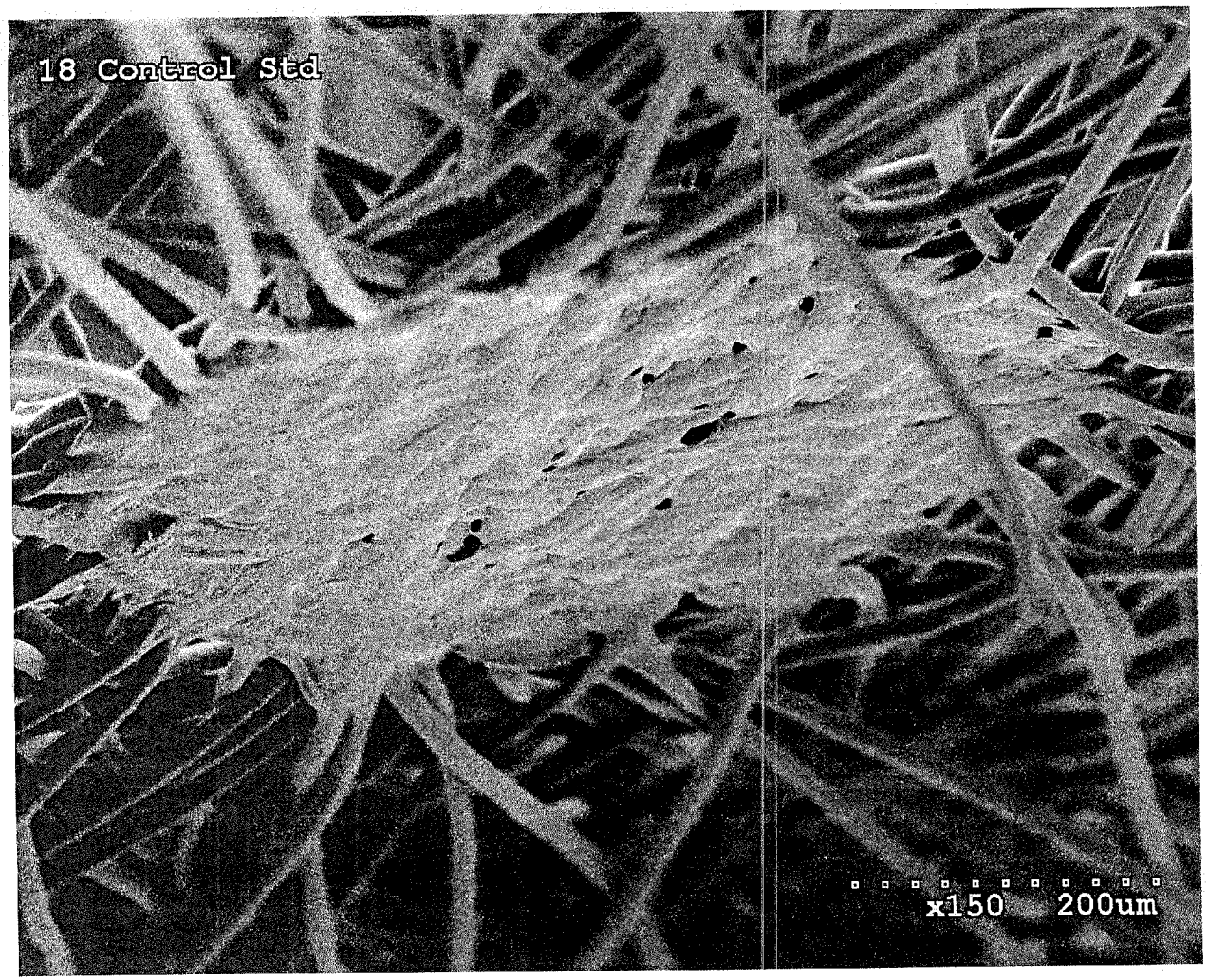
FIG. 11 is a top plan SEM (scanning electron microscope) photograph at a magnification of 150× of a spunbond nonwoven having an isotropic pattern of fusion bonds, pre-hydroengorgement.
Figure 12:
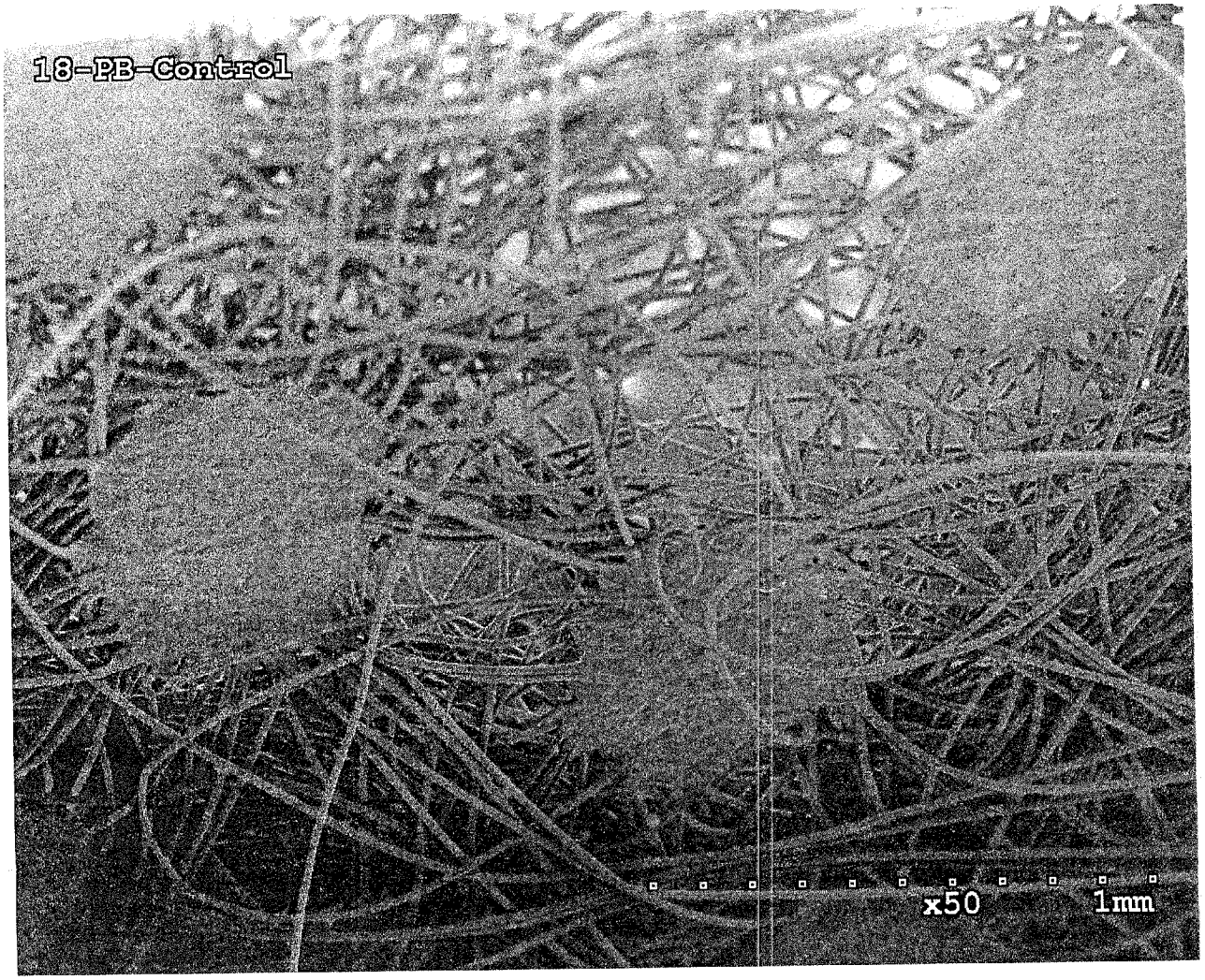
FIG. 12 is a top plan SEM photograph at a magnification of 50× of a spunbond nonwoven having an anisotropic pattern of fusion bonds, pre-hydroengorgement.
Figure 15:
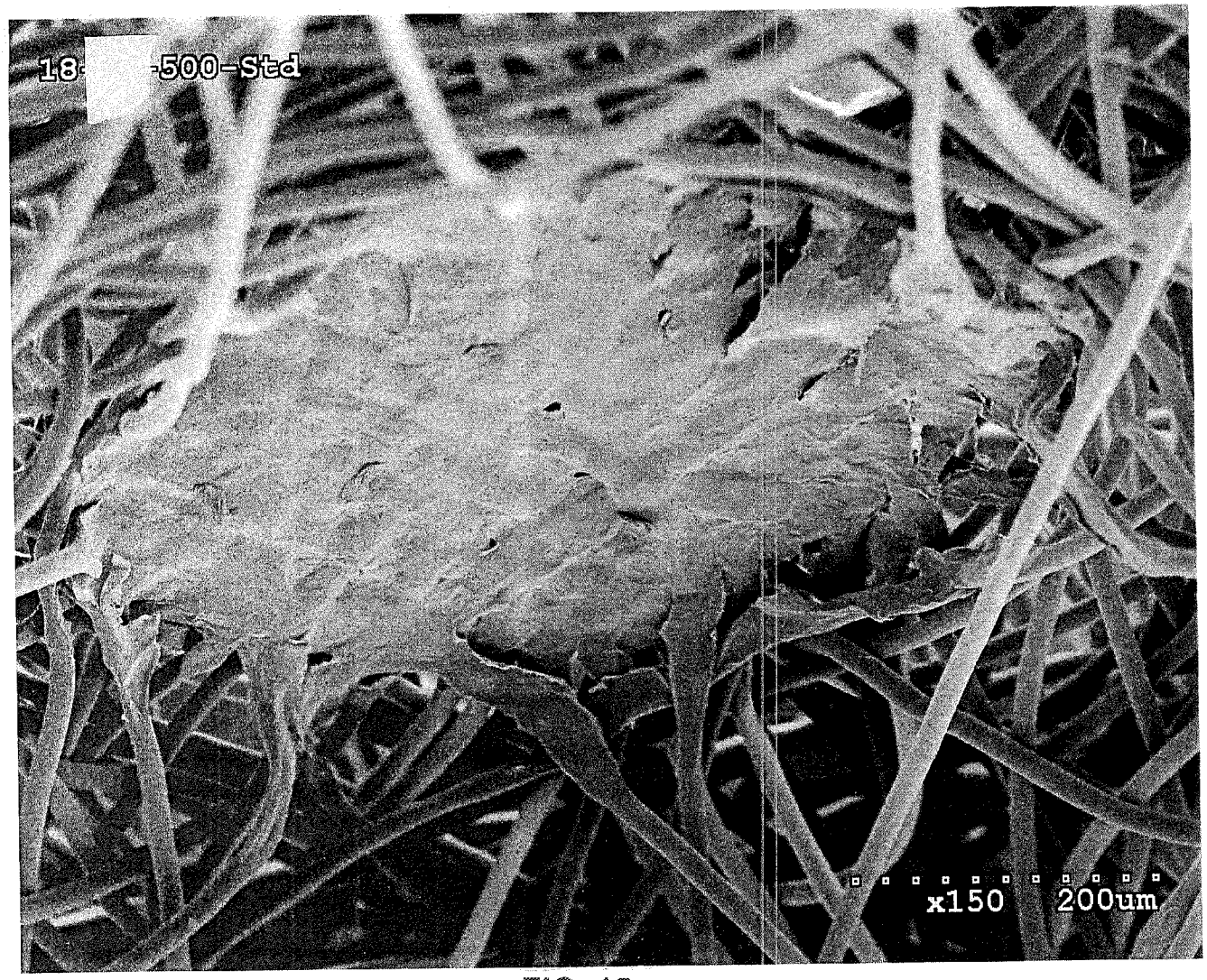
FIG. 15 is a top plan SEM photograph at 150× magnification of an spunbond nonwoven having an isotropic pattern of fusion bonds, post-hydroengorgement.

FIG. 11 is a top plan view of a typical bond and its environs for a spunbond nonwoven having an isotropic pattern of fusion bonds before hydroengorgement. By way of comparison, FIG. 12 is a top plan view of several bonds and their environs for a spunbond nonwoven having an anisotropic pattern of fusion bonds before hydroengorgement. FIG. 15 is a top plan view of a typical bond and its environs for a spunbond nonwoven having an isotropic pattern of fusion bonds after hydroengorgement.

Figure 13:
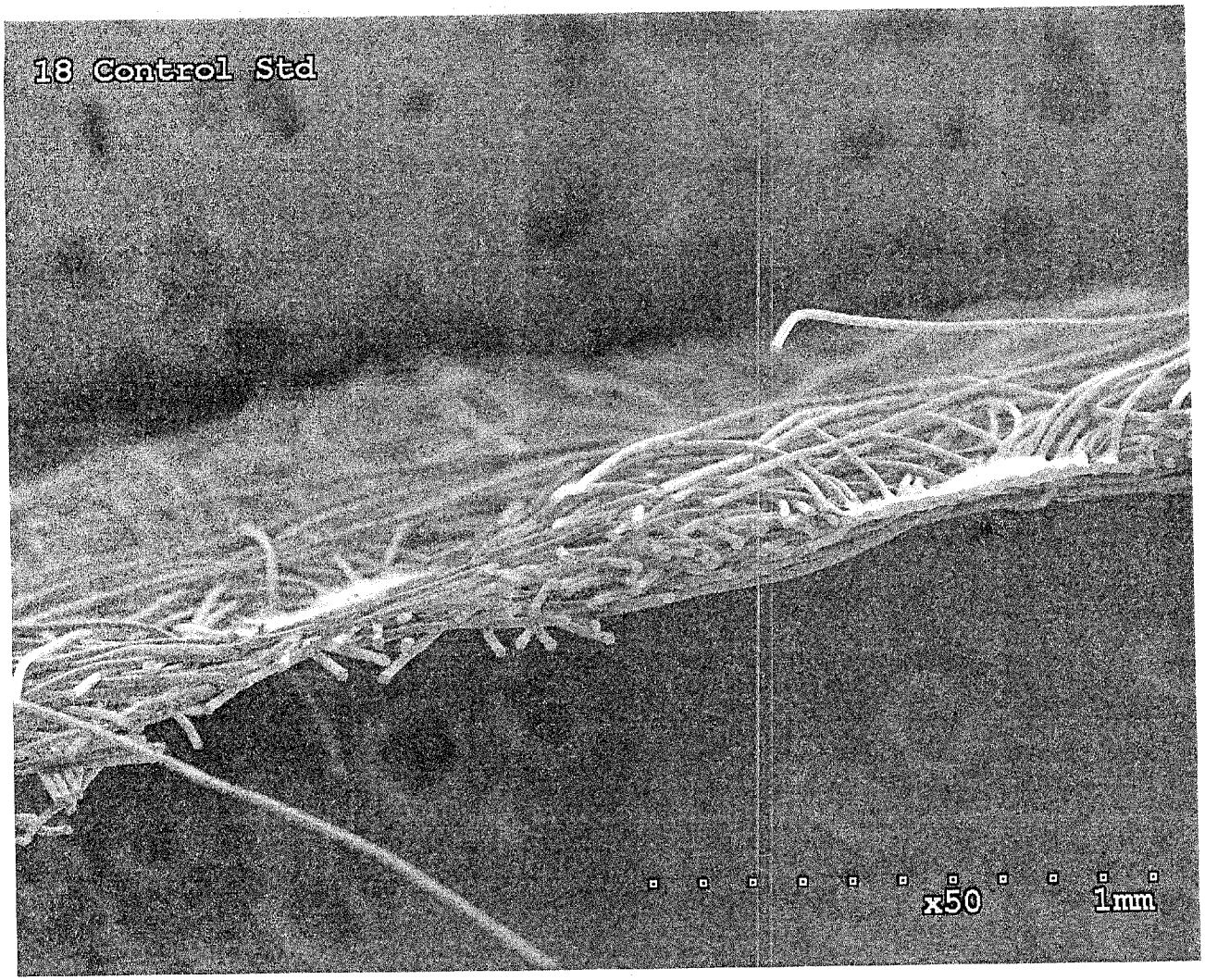
FIG. 13 is SEM photograph at 50× magnification of a cross-section of a spunbond nonwoven having an isometric pattern of fusion bonds, pre-hydroengorgement.
Figure 14:
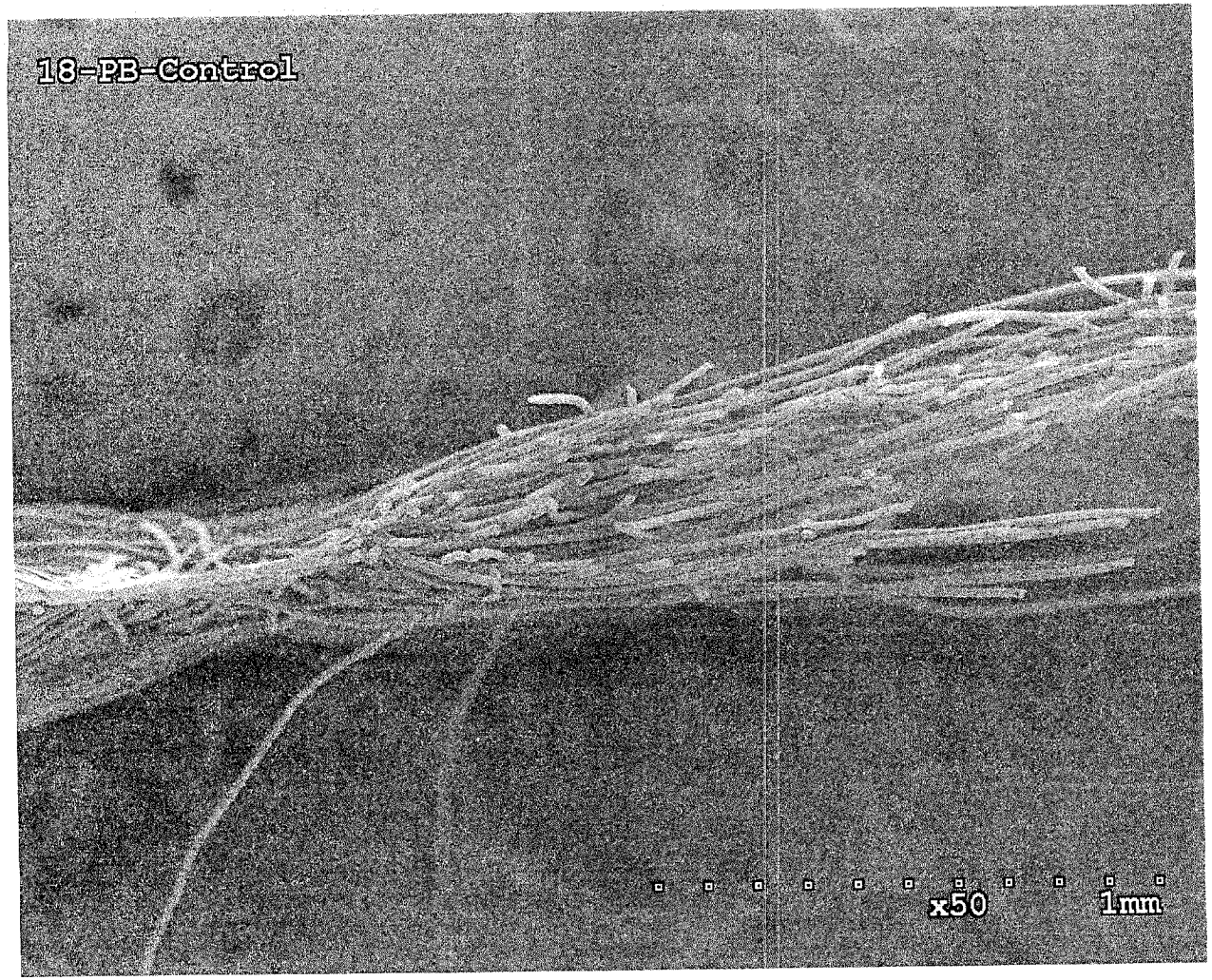
FIG. 14 is a SEM photograph at 50× magnification of a cross-section of a spunbond nonwoven having an anisotropic pattern of fusion bonds, pre-hydroengorgement.
Figure 16:
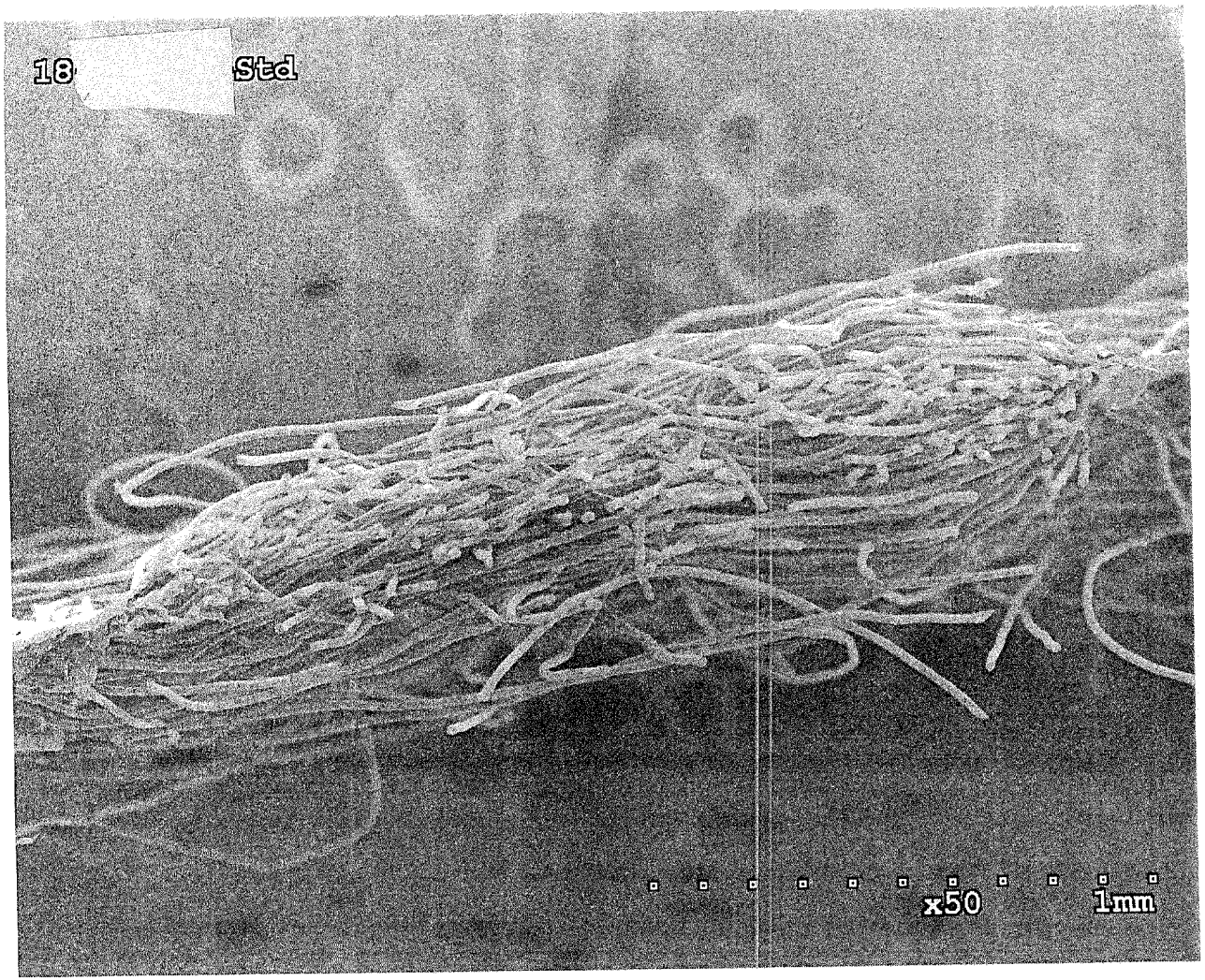
FIG. 16 is an SEM photograph at 50× magnification, partially in section, of a cross-section of a spunbond nonwoven having an isotropic pattern of fusion bonds, post-hydroengorgement.
Figure 17:
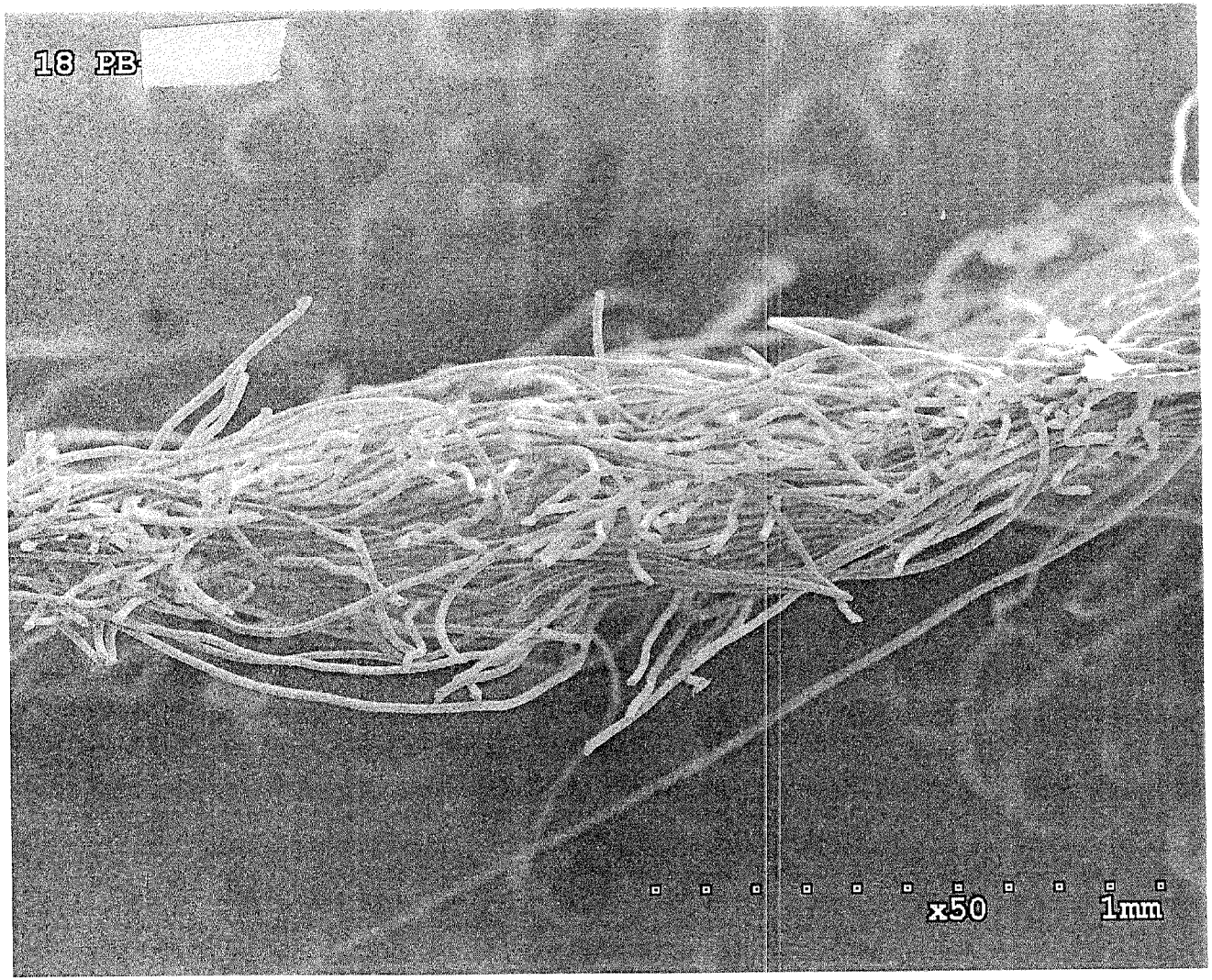
FIG. 17 is an SEM photograph at 50× magnification, partially in section, of a cross-section of a spunbond nonwoven having an anisotropic pattern of fusion bonds, post-hydroengorgement.

FIGS. 13 and 14 are sectional views of the nonwovens of FIGS. 11 and 12, respectively. FIGS. 16 and 17 are similar sectional views of spunbond nonwoven materials having anisotropic patterns of fusion bonds, after hydroengorgement. The increased caliper $C_1$ of the hydroengorged materials of FIGS. 16 and 17 relative to the original caliper $C_0$ of the non-hydroengorged materials of FIGS. 13 and 14, respectively, is clear.

In a preferred embodiment of the present invention, the hydroengorged spunmelt nonwoven may be treated with a finish to render it softer and more condrapable, such a finish being disclosed in U.S. Pat. No. 6,632,385, which is hereby incorporated by reference, or to modify the surface energy thereof and thereby render it either hydrophobic or more hydrophobic or hydrophilic or more hydrophilic.

The hydroengorged spunmelt nonwoven may be incorporated in an absorbent article (particular, e.g., as a cover sheet or a back sheet) or in a non-absorbent article. A particularly useful application of the present invention is as a component of a laminate or blend (mixture) with, for example, meltblown or spunbond fibers, staple fibers, cellulosic or synthetic pulp, rayon fibers and other nonwovens—e.g., an SMS nonwoven.

Another particularly useful application of the present invention is as the "loop" material of a hook-and-loop closure system. Other uses of the hydroengorged synthetic fiber structure will be readily apparent to those skilled in the art.

Figure 19:
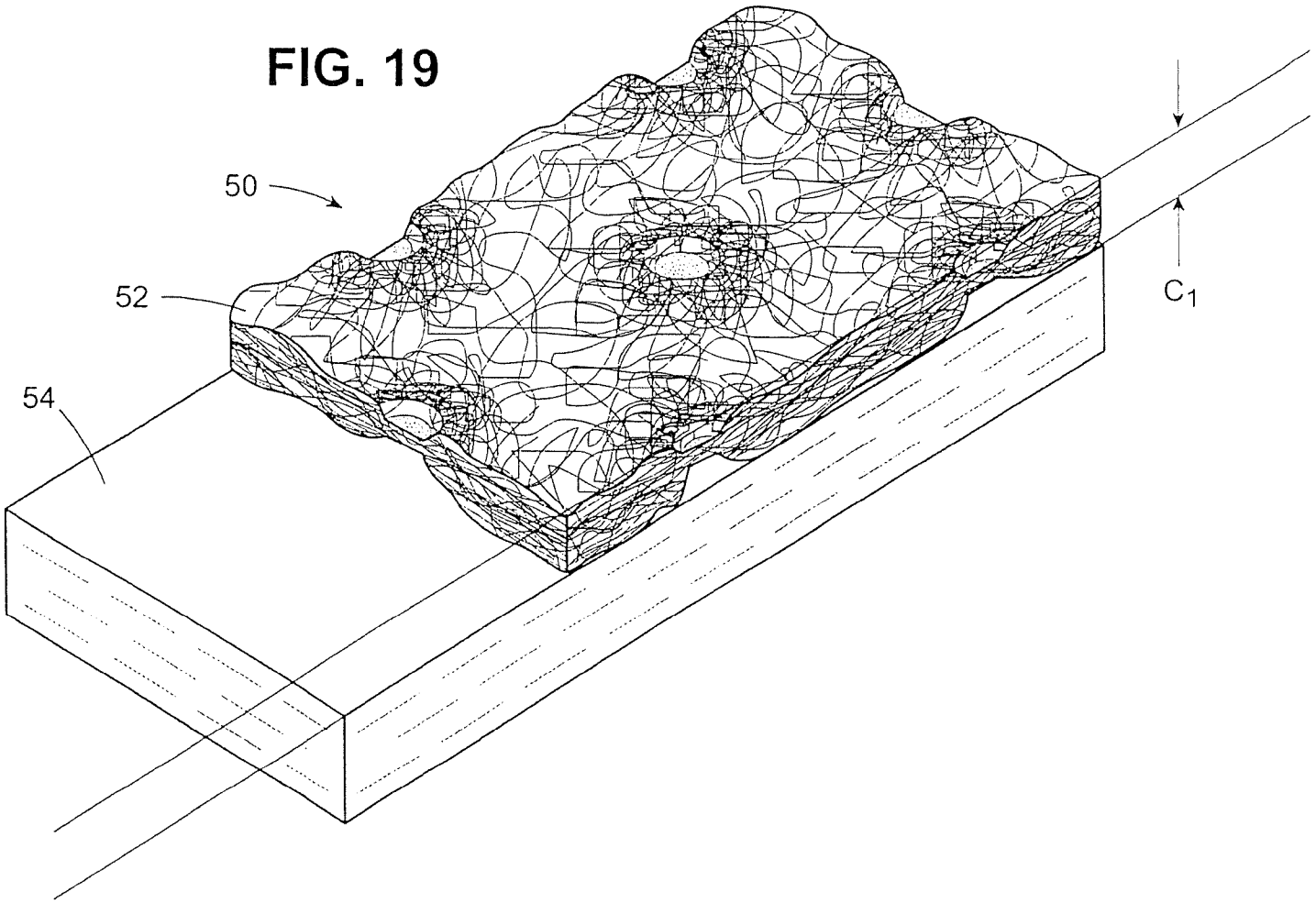
FIG. 19 is a fragmentary isometric schematic of a laminate including a nonwoven according to the present invention.

FIG. 19 is a fragmentary isometric schematic view of a laminate 50 formed of a hydroengorged nonwoven 52 having an anisotropic pattern of fusion bond points (and a caliper $C_1$) and a substrate 54. Substrate 54 may be either absorbent or non-absorbent. Although it cannot be seen, the fibers of the hydroengorged nonwoven 52 are optionally coated with a finish which can increase the condrapable nature thereof or modify the surface energy thereof as described hereinabove (to render it either hydrophobic or more hydrophobic or hydrophilic or more hydrophilic). This substrate 54 may be formed of meltblown or spunbond fibers, staple fibers, cellulosic or synthetic pulp, rayon fiber or another nonwoven (such as an SMS) nonwoven.

EXAMPLE

Three samples of a polypropylene spunbond nonwoven were obtained, each having a basis weight of about 18.0 g/m$^2$. Samples A, B and C are available from First Quality Nonwovens, Inc. under the trade names 18 GSM SB HYDROPHOBIC for Samples A and B and 18 GSM PB-SB HYDROPHOBIC for Sample C. Samples A and B had a standard isotropic bonding pattern called "oval pattern." Sample C had an anisotropic bonding pattern which was also orthogonally differential. Each of the samples had fusion bonds of identical dimensions and configuration, each sample having a percentage bond area of about 18.5%.

Each of the samples was passed at a travel speed of 400 meters/minute through a hydroengorgement operation which provided hydromechanical impact through the use of water jets with medium hydraulic pressure on each of the two nonwoven surfaces. The water orifices were arranged in a single row on each side of the nonwoven, the single row extending across the width of the nonwoven Each row had a linear density of 40 water orifices per inch, with the diameter of each water orifice being 0.12 millimeters. The hydraulic pressure was applied at 240 bars. The forming surface located under the nonwoven and on top of the water suction slot was a woven wire surface of 25-30 mesh.

The properties of the pre- and post-hydroengorgement samples were determine according to ASTM or INDA test procedures and recorded in the TABLE, with the changes in data resulting from hydroengorgement being indicated for the post-hydroengorgement samples A', B' and C'.

Samples A', B' and C' are identified in the TABLE as "SBHE" to indicate that they represent the spunbond (SB) nonwoven post-hydroengorgement (HE), as opposed to the Samples A, B and C which are indicated as "control" because they represent the samples pre-hydroengorgement. Of the six samples, Sample C' represents a nonwoven according to the present invention—that is, a hydroengorged nonwoven having an anisotropic pattern of fusion bonds.

Figure 18:
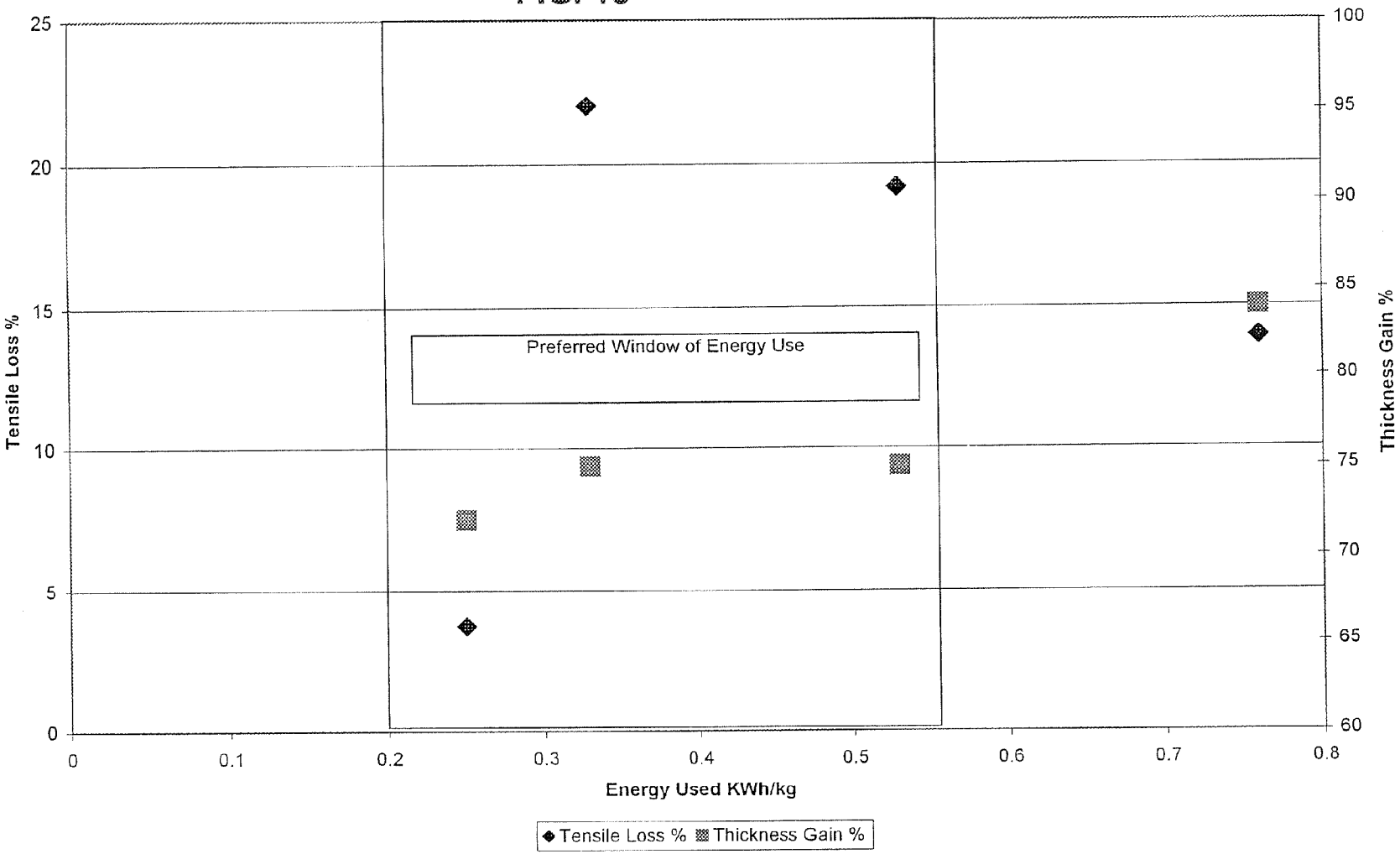
FIG. 18 is a graph showing the effect of the energy used (kilowatt hours per kilogram of fabric) on the percentage loss in tensile strength of the fabric and the percentage gained in thickness (caliper) of the fabric with a preferred window of energy use for hydroengorgement being indicated.

The TABLE also indicates the amount of energy used during the hydroengorgement operation for each sample. By reference to FIG. 18, it will be appreciated that the amount of energy used was within a so-called "preferred window of energy use" where a balance between the maximum thickness increase and the lowest tensile loss is achieved at a practical and economical level of energy for use in the hydroengorgement process. The difference in the post-hydroengorgement properties of Samples A' and B' is essentially attributable to the difference in the energy levels employed in their hydroengorgement processes.

Air permeability data is included in the TABLE because hydroengorgement has the effect of opening the pores of the nonwoven, thereby increasing its air permeability, which opening of the pores in turn is related to both softness and thickness (caliper).

As illustrated in the TABLE each of the post-hydroengorgement Samples A', B' and C' had increased caliper (thickness) and drape/softness (as measured by a Handle-O-Meter from Thwing Albert using an 4×4 inch specimen) with only a moderate MD tensile loss compared to the respective pre-hydroengorgement Samples A, B and C. Each of the samples also demonstrated sufficient abrasion resistance after hydroengorgement for use, e.g., as a wipe or as an outer cover of an absorbent article.

However, only Sample C' exhibited a thickness increase greater than 50%, its actual increase of 74.6% being about twice that of Sample B' and more than 5 times that of Sample A'. This is particularly significant in view of the fact that the energy used in the hydroengorgement process to produce Sample C' is significantly less than the energy used in the hydroengorgement processes to produce Samples A' and B'. In other words, Sample C' shows a substantially and significantly greater percentage increase in thickness at a lower energy cost than Samples A' and B'.

Only Sample C' exhibited a MD tensile loss of less than 25%. Its MD tensile loss was only 21.9% relative to the 29.7% and 27.6% losses exhibited by Samples A' and B', respectively. In other words Sample C' underwent less than 80% of the tensile losses of Samples A' and B'.

Only Sample C' exhibited an increase in air permeability of at least 30%. Its air permeability increase was 37.6%, while Samples A' and B' illustrated increases of only 14.9 and 25.9%, respectively. In other words, Sample C' underwent an increase in air permeability which was about 150-250% of the increase for Samples A' and B'. This high air permeability increase in Sample C' reflects superior bulking thereof as a result of the hydroengorgement process.

The increase in softness (as measured by the Handle-O-Meter) for Sample C' is smaller than the increase in softness for Samples A' and B', but this is easily explained because Sample C is already the softest of the pre-hydroengorgement or control samples. This is because the anisotropic bonding pattern used therein typically already produces a softer nonwoven than the isotropic bonding pattern, and thus there is less room for an increase in the softness due to hydroengorgement within the preferred window of energy use.

Accordingly, the present invention provides a hydroengorged spunmelt nonwoven formed of thermoplastic continuous fibers and a pattern of fusion bonds. The nonwoven may have a positive percentage bond area of less than 10% or, where the pattern of fusion bonds is anisotropic, a percentage bond area of at least 10%. The nonwoven typically exhibits after hydroengorgement an increase in caliper of at least 50% and a tensile strength of at least 75% of the tensile strength exhibited by the nonwoven prior to hydroengorgement.

Now that the preferred embodiments have been shown and described in detail, various modifications and improvements thereon will be readily apparent to those skilled in the art. Accordingly, the spirit and scope of the present invention is to be construed broadly and be limited only by the appended claims, and not by the foregoing specification.

We claim:

1. A process of producing a hydroengorged spunmelt nonwoven comprising:

providing a fusion bonded spunmelt nonwoven; and imparting hydraulic energy from hydraulic jets to said nonwoven, thereby increasing the caliper and softness of said nonwoven.

2. The process of claim 1, wherein said hydraulic energy is imparted directly to said nonwoven.

3. The process of claim 1, wherein said nonwoven exhibits an increase of at least 50% in caliper after said hydraulic energy is imparted relative to said nonwoven before said hydraulic energy is imparted.

4. The process of claim 1, wherein said nonwoven exhibits an increase in softness of at least 10% after said hydraulic energy is imparted relative to said nonwoven before said hydraulic energy is imparted.

5. The process of claim 1, wherein said nonwoven exhibits a tensile strength after said hydraulic energy is imparted of at least 75% of the tensile strength exhibited by said nonwoven before said hydraulic energy is imparted.

6. The process of claim 1, wherein said nonwoven exhibits an increase of at least 10% in density after said hydraulic energy is imparted relative to said nonwoven before said hydraulic energy is imparted.

7. The process of claim 1, wherein the pressure applied by the hydraulic jets is between about 180 to 280 bar.

8. The process of claim 7, wherein the pressure applied by the hydraulic jets is about 240 bar.

9. The process of claim 1, wherein the travel speed of said nonwoven past said hydraulic jets is about 400 meters per minute.

10. The process of claim 1, wherein hydraulic energy is imparted to both sides of said nonwoven.

11. The process of claim 1, wherein the spunmelt nonwoven comprises thermoplastic continuous fibers.

12. The process of claim 1, wherein said nonwoven has one of a positive percentage fusion bond area of less than 10%, and a percentage fusion bond area of at least 10% wherein said bonding pattern of fusion bonds is anisotropic.

13. The process of claim 1, wherein said nonwoven has a percentage bond area of at least 10% wherein said bonding pattern of fusion bond points is anisotropic.

14. The process of claim 1, wherein said nonwoven is orthogonally differentially bonded with fusion bond points.

15. The process of claim 1, wherein said bonds have a maximum dimension d, and a maximum bond separation of at least 4d.

16. The process of claim 1 having a basis weight of 5-50 gsm.

17. The process of claim 1, further comprising:

finishing said nonwoven to modify the surface energy thereof.

18. The process of claim 1, further comprising:

finishing said nonwoven to increase the condrapable nature thereof.

* * * * *